US008525582B2

(12) United States Patent
Matsubara

(10) Patent No.: US 8,525,582 B2
(45) Date of Patent: Sep. 3, 2013

(54) CURRENT-SOURCE CIRCUIT

(75) Inventor: Satoshi Matsubara, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 204 days.

(21) Appl. No.: 13/106,334

(22) Filed: May 12, 2011

(65) Prior Publication Data

US 2011/0304362 A1 Dec. 15, 2011

(30) Foreign Application Priority Data

Jun. 14, 2010 (JP) ..... 2010-135347

(51) Int. Cl.
*G05F 1/10* (2006.01)

(52) U.S. Cl.
USPC ..... 327/543; 327/404

(58) Field of Classification Search
USPC ..... 323/312, 315; 327/403, 404, 405, 327/535, 537, 538, 543
See application file for complete search history.

(56) References Cited

U.S. PATENT DOCUMENTS

| | | | | |
|---|---|---|---|---|
| 6,462,527 | B1 * | 10/2002 | Maneatis | 323/315 |
| 6,924,601 | B2 | 8/2005 | Date | |
| 7,071,771 | B2 * | 7/2006 | Takano et al. | 327/543 |
| 7,265,495 | B2 | 9/2007 | Date | |
| 7,468,625 | B2 * | 12/2008 | Koizumi et al. | 327/543 |
| 7,636,014 | B1 * | 12/2009 | Chen | 330/254 |

FOREIGN PATENT DOCUMENTS

JP 2004-198770 A 7/2004

* cited by examiner

*Primary Examiner* — Jeffrey Zweizig
(74) *Attorney, Agent, or Firm* — Fujitsu Patent Center

(57) ABSTRACT

A current-source circuit includes a plurality of input-side transistors; a plurality of output-side transistors current-mirror-coupled to the plurality of input-side transistors; an output terminal from which an output current is output; and a switching control circuit to switch the plurality of input-side transistors and activate at least one of the plurality of input-side transistors sequentially.

14 Claims, 12 Drawing Sheets

CURRENT-SOURCE CIRCUIT

CROSS-REFERENCE TO RELATED APPLICATIONS

This application claims the benefit of priority from Japanese Patent Application No. 2010-135347 filed on Jun. 14, 2010, the entire contents of which are incorporated herein by reference.

BACKGROUND

1. Field

The embodiments discussed herein relate to a current-source circuit.

2. Description of Related Art

A current mirror circuit generates an output current by copying an input current with an arbitrary scaling factor.

The related art is disclosed in Japanese Laid-open Patent Publication No. 2004-198770 or the like.

SUMMARY

According to one aspect of the embodiments, a current-source circuit includes: a plurality of input-side transistors; a plurality of output-side transistors current-mirror-coupled to the plurality of input-side transistors; an output terminal from which an output current is output; and a switching control circuit to switch the plurality of input-side transistors and activate at least one of the plurality of input-side transistors sequentially.

The object and advantages of the invention will be realized and achieved by at least the features, elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Figure 1:
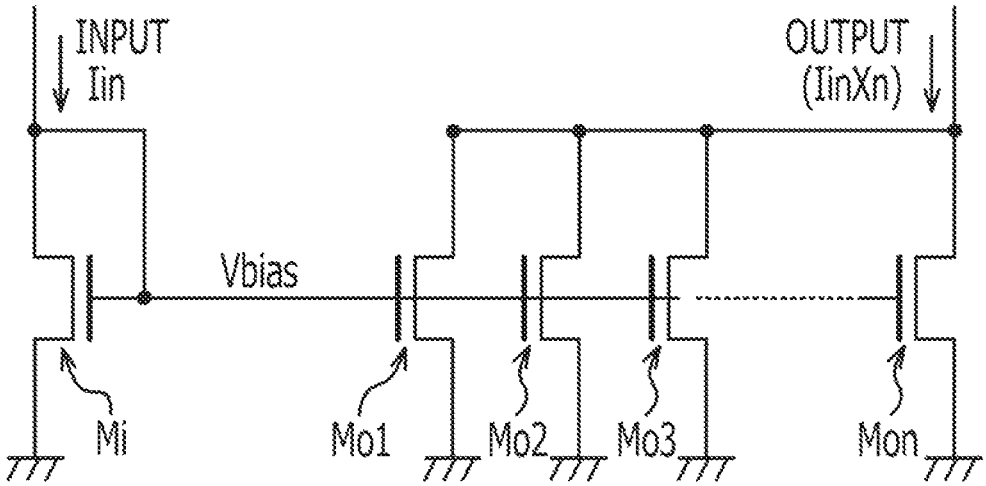
FIG. 1 illustrates an exemplary current mirror circuit.

FIG. 1 illustrates an exemplary current mirror circuit. In order to obtain an output current having a magnitude n times that of an input current, n transistors that are substantially the same as input-side transistors are arranged in parallel on an output side. For example, when the current mirror ratio is 1:n (an amplification factor of n), output-side transistors Mo1 to Mon are arranged, the number of which is n times the number of input-side transistors Mi. An output current represented by an expression (Iin×n) is obtained based on an input current Iin.

A standard deviation value G of a process-dependent relative variation, such as a variation in the threshold or saturation current of transistors, may be inversely proportional to an expression $\sqrt{(\text{area})}$. For example, the smaller the size of an element, the larger the standard deviation value G of the process-dependent relative variation. In order to stabilize the output current of the current mirror circuit illustrated in FIG. 1, a variation in the characteristics of the input-side transistors Mi is reduced. For example, the size of the input-side transistors Mi may be increased.

When the size of the input-side transistors Mi is increased, the size of the output-side transistors Mo may also be increased.

A current-source circuit includes a current mirror circuit that outputs an output current in accordance with an input current, e.g., an output current which is obtained by copying an input current with an arbitrary scaling factor. The current-source circuit may be used in an interface device for high-speed communication, which includes a high-speed latch circuit, a high-speed phase adjustment circuit, or the like, an external input/output interface device having a high accuracy, or the like. For example, the current-source circuit may be used in a current source for an output buffer of an interface device that conforms to a Universal Serial Bus (USB) standard, or in a current source for an output buffer of an output amplifier device.

Figure 2:
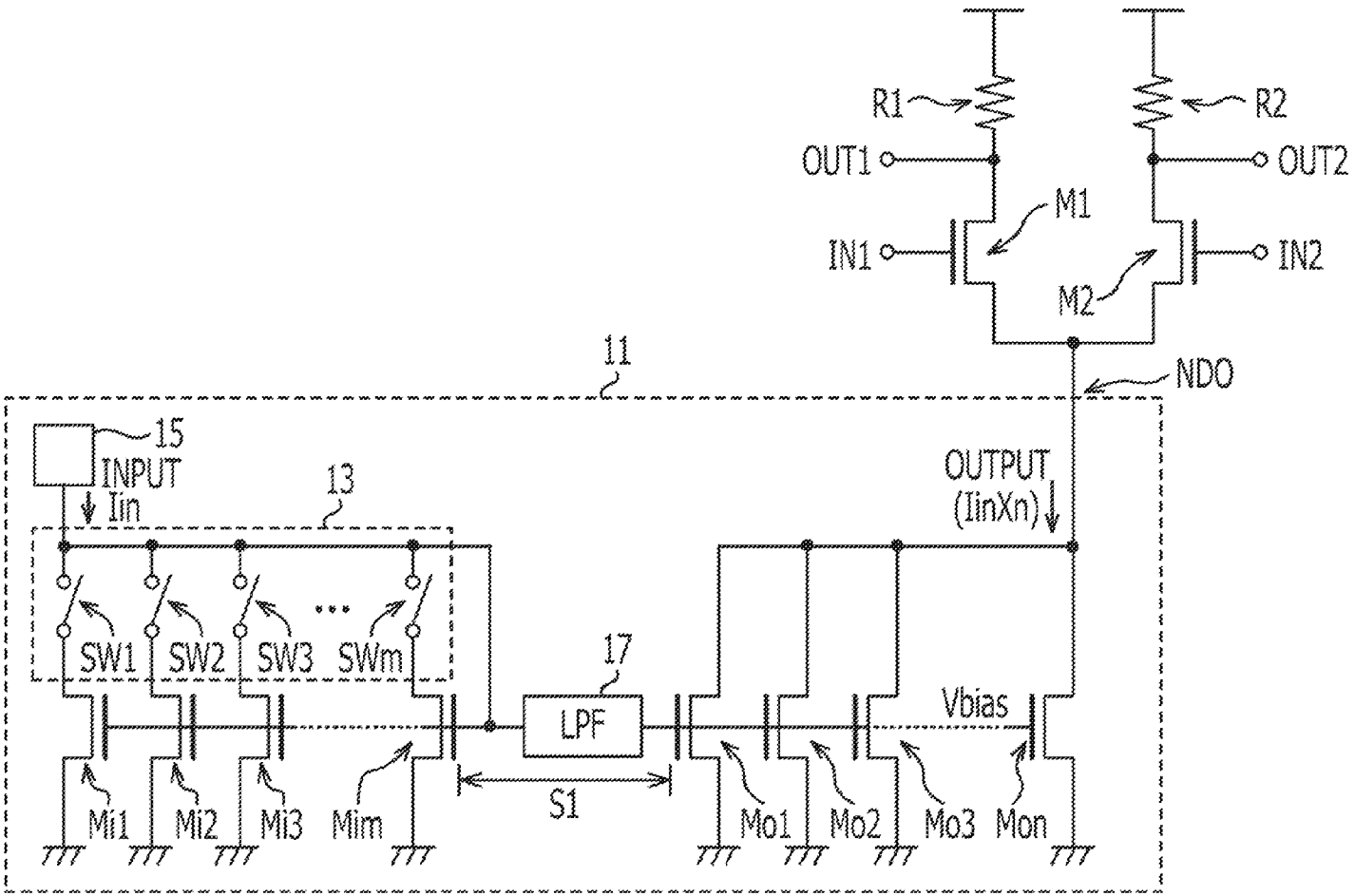
FIG. 2 illustrates an exemplary semiconductor device.

FIG. 2 illustrates an exemplary semiconductor device. The semiconductor device illustrated in FIG. 2 includes a differential amplifier that uses a current-source circuit as a current source, e.g., a differential output buffer. Reference numerals R1 and R2 denote resistors. Reference numerals M1 and M2 denote metal oxide semiconductor (MOS) transistors. Reference numeral 11 denotes a current-source circuit.

The resistors R1 and R2 may correspond to load elements of the differential amplifier. One of two ends of the resistor R1 is coupled to a power supply voltage (VDD), and the other end of the resistor R1 is coupled to the drain of the MOS transistor M1. One of two ends of the resistor R2 is coupled to the power supply voltage (VDD), and the other end of the resistor R2 is coupled to the drain of the MOS transistor M2.

The MOS transistors M1 and M2 may correspond to drive elements of the differential amplifier. The gate of the MOS transistor M1 is coupled to an input terminal IN1 to which one of two differential input signals is input. The source of the MOS transistor M1 is coupled to an output-current node (an output terminal) NDO through which an output current of the current-source circuit 11 flows. The gate of the MOS transistor M2 is coupled to an input terminal IN2 to which the other differential input signal is input. The source of the MOS transistor M2 is coupled to the output-current node NDO through which an output current of the current-source circuit 11 flows.

In the differential amplifier, a voltage at a node at which the resistor R1 and the drain of the MOS transistor M1 are coupled to each other is output as a signal OUT1 that is one of two differential output signals. A voltage at a node at which the resistor R2 and the drain of the MOS transistor M2 are coupled to each other is output as a signal OUT2 that is the other differential output signal.

The current-source circuit 11 includes a plurality of MOS transistors Mi, a plurality of MOS transistors Mo, a switching control circuit 13, and an input-current supply circuit 15. The MOS transistors Mi (Mi1, Mi2, Mi3, . . . , and Mim) may correspond to input-side transistors to which an input current is input. The drains of the individual input-side transistors Mi are coupled to the input-current supply circuit 15 via the switching control circuit 13. The sources of the individual input-side transistors Mi are coupled to a reference potential (VSS), e.g., the ground. The gates of the individual input-side transistors Mi are coupled to the input-current supply circuit 15.

The MOS transistors Mo (Mo1, Mo2, Mo3, . . . , and Mon) may correspond to output-side transistors that are coupled to the input-side transistors Mi so as to form a current mirror. An output current that is proportional to the input current flowing through the input-side transistors Mi is generated by the MOS transistors Mo. The drains of the individual output-side transistors Mo are coupled to the output-current node NDO. The sources of the individual output-side transistors Mo are coupled to the reference potential (VSS), e.g., the ground. The gates of the individual output-side transistors Mo are coupled to the gates of the input-side transistors Mi.

The switching control circuit 13 sequentially switches among the input-side transistors Mi to be activated. The switching control circuit 13 includes switches SW1, SW2, SW3, . . . , and SWm (hereinafter, referred to as "switches SW" in some cases) that correspond to the input-side transistors Mi1, Mi2, Mi3, . . . , and Mim, respectively. The input-current supply circuit 15 supplies the input current to the input-side transistors Mi.

The switches SW1, SW2, SW3, . . . , and SWm of the switching control circuit 13 are arranged along current paths, provided between the input-current supply circuit 15 and the input-side transistors Mi, through which the input current flows, and are controlled based on control signals that are independent of one another. The switching control circuit 13 couples the input-current supply circuit 15 and the drains of the input-side transistors Mi via the switches SW1, SW2, SW3, . . . , and SWm, respectively, thereby switching among the input-side transistors Mi to be activated.

For example, when the current mirror ratio is 1:n, the switches SW1, SW2, SW3, . . . , and SWm of the switching control circuit 13 are controlled so that one of the switches is turned on and the other switches are turned off at a certain timing. For example, at a certain timing during an operation, the switches are controlled so that one input-side transistor Mi among the input-side transistors Mi1, Mi2, Mi3, . . . , and Mim is activated. The input current flowing through the one activated input-side transistor Mi is copied by the n output-side transistors Mo to generate an output current, and the output current n times that of the input current supplied from the input-current supply circuit 15 flows through the output-current node NDO. For example, when the input current supplied from the input-current supply circuit 15 is denoted by Iin, the output current flowing through the output-current node NDO may be represented by an expression (Iin×n).

For example, when the current mirror ratio is 1:(n/2), the switches SW1, SW2, SW3, . . . , and SWm of the switching control circuit 13 are controlled so that two of the switches are turned on and the other switches are turned off. For example, the switches are controlled so that two input-side transistors Mi among the input-side transistors Mi1, Mi2, Mi3, . . . , and Mim are activated. The input current that flows through the two activated input-side transistors Mi is copied by the n output-side transistors Mo to generate an output current, and the output current n/2 times the input current supplied from the input-current supply circuit 15 flows through the output-current node NDO.

In the current-source circuit 11, the input-side transistors Mi that are coupled in parallel in the current mirror circuit are provided. Mi to be activated is switched among the input-side transistors, thereby activating one of or some of the input-side transistors Mi. Because at least one of the input-side transistors Mi is activated, a variation in the characteristics of the input-side transistors Mi is averaged. A variation in the characteristics of the entire circuit may be reduced. The variation in the characteristics of the input-side transistors Mi due to a process-dependent relative variation is reduced, and the stability of the output current is increased. Thus, the yield may be increased.

For example, when at least one of the input-side transistors Mi is activated at time intervals that are substantially the same as each other, the standard deviation value G of the characteristics of the process-dependent relative variation may be reduced to be $(1/\sqrt{(\text{aparallelnumber})})$. The parallel number may be the number of input-side transistors Mi to be activated in parallel, e.g., the number of input-side transistors Mi to be activated. When the input-side transistors Mi to be activated are switched at time intervals that are not substantially the same as each other, the variation in the characteristics of the input-side transistors Mi is averaged by switching the input-side transistors Mi. Accordingly, the standard deviation value G of the characteristics of the process-dependent relative variation may be reduced. Because the input-side transistors Mi to be activated are switched sequentially, a variation in the temperature characteristics of the input-side transistors Mi is averaged, so that the variation in the characteristics of the input-side transistors Mi due to the variation in the temperature characteristics may be reduced.

Because the variation in the characteristics is reduced by averaging the variation in the characteristics of the input-side transistors Mi, the sizes of the elements included in the current mirror circuit are reduced, and the circuit scale is reduced. For example, when the current mirror ratio is 1:100 and the size of the input-side transistors Mi is eight times the original, for example, the number of input-side transistors Mi is eight, the number of output-side transistors Mo may be 800 in order to reduce the variation in the characteristics of the input-side transistors Mi. If one input-side transistor Mi among the eight input-side transistors Mi is activated, the number of output-side transistors Mo may be 100. When the variations in the characteristics of the input-side transistors Mi are substantially the same, the area of the current mirror circuit having the current mirror ratio of 1:100 may be reduced to be about ⅛ of the original, e.g., 108/808 of the original.

A low-pass filter 17 having a time constant that is longer than a switching cycle of the switching control circuit 13 may be provided between the gates of the input-side transistors Mi and the gates of the output-side transistors Mo of the current-source circuit 11 illustrated in FIG. 2. When the low-pass filter 17 is provided, switching noise that occurs during switching control performed by the switching control circuit 13 is not transmitted to the output side, and a voltage at a node Vbias may be stabilized. The low-pass filter 17 may be provided in, for example, a position range S1 between the gates of the input-side transistors Mi and the gates of the output-side transistors Mo illustrated in FIG. 2. The low-pass filter 17 may include a parasitic element or the like.

Figure 3:
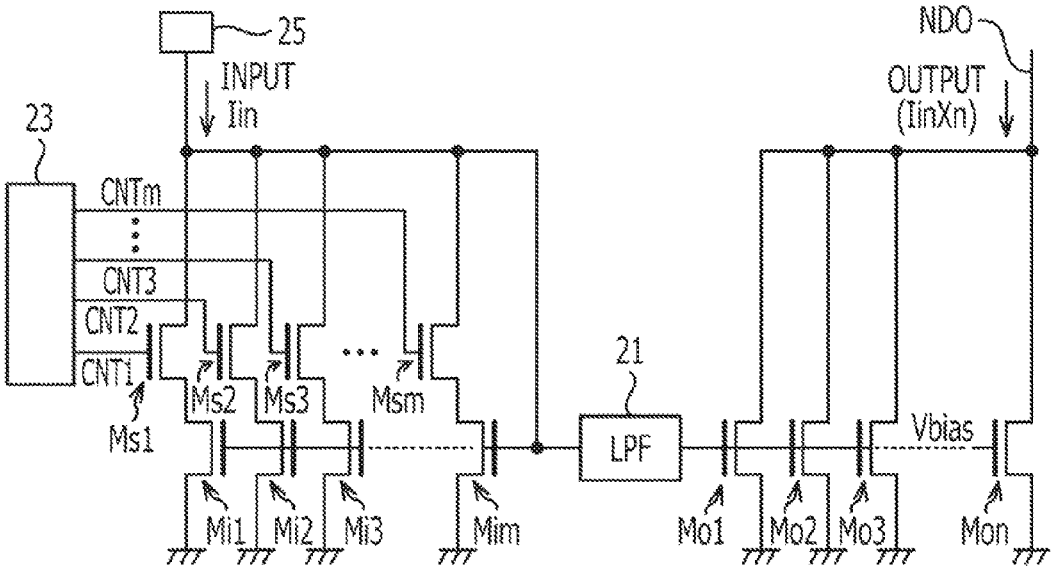
FIG. 3 illustrates an exemplary current-source circuit.

FIG. 3 illustrates an exemplary current-source circuit. A switching control circuit of the current-source circuit illustrated in FIG. 3 includes switches SW1, SW2, SW3, . . . , and SWm that are n-channel MOS (NMOS) transistors. Reference numerals Mi, Mo, and Ms illustrated in FIG. 3 denote NMOS transistors. Reference numeral 21 denotes a low-pass filter. Reference numeral 23 denotes a control-signal generating circuit. Reference numeral 25 denotes an input-current supply circuit 25.

The NMOS transistors Mi may correspond to the input-side transistors Mi illustrated in FIG. 2. The NMOS transistors Mo may correspond to the output-side transistors Mo illustrated in FIG. 2. The NMOS transistors Ms may correspond to the switches SW included in the switching control circuit 13 illustrated in FIG. 2. The low-pass filter 21 and the input-current supply circuit 25 may correspond to the low-pass filter 17 and the input-current supply circuit 15, respectively, which are illustrated in FIG. 2.

The NMOS transistors Mi (Mi1, Mi2, Mi3, . . . , and Mim) may be input-side transistors to which an input current is input. The NMOS transistors Mo (Mo1, Mo2, Mo3, . . . , and Mon) may correspond to output-side transistors that are current-mirror-coupled to the input-side transistors Mi so that an output current flows in accordance with the input current flowing into the input-side transistors Mi. The NMOS transistors Ms (Ms1, Ms2, Ms3, . . . , and Msm) are provided for the input-side transistors Mi1, Mi2, Mi3, . . . , and Mim, respectively, and may correspond to switches for switching whether or not the corresponding input-side transistors Mi are to be activated.

Regarding the individual input-side transistors Mi, the drains thereof are coupled to the sources of the corresponding NMOS transistors Ms, the sources thereof are coupled to a reference potential VSS, e.g., the ground, and the gates thereof are coupled to the input-current supply circuit 25. Regarding the individual output-side transistors Mo, the drains thereof are coupled to an output-current node NDO, the sources thereof are coupled to the reference potential VSS, e.g., the ground, and the gates thereof are coupled mutually to the gates of the input-side transistors Mi. Regarding the individual NMOS transistors Ms, the drains thereof are coupled to the input-current supply circuit 25, and control signals CNT are supplied to the gates thereof.

Figure 4A:
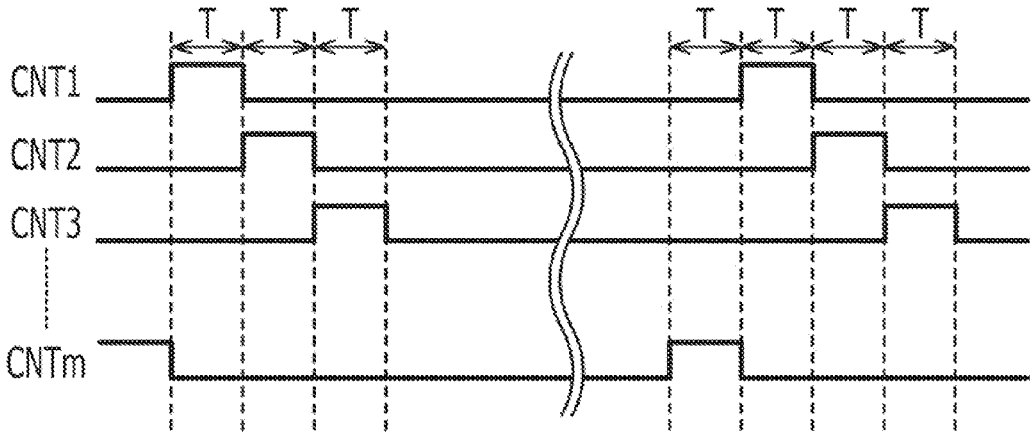
FIGS. 4A and 4B illustrate exemplary drive waveforms of control signals.
Figure 4B:
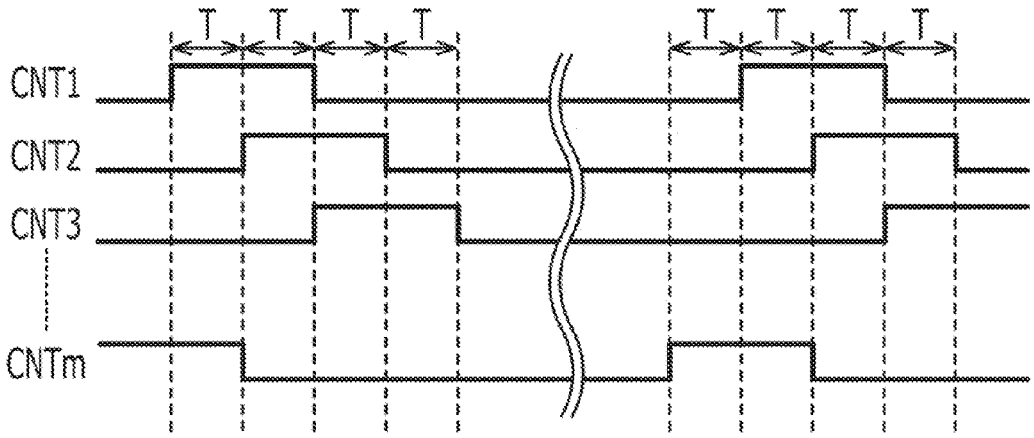

The NMOS transistors Ms1, Ms2, Ms3, . . . , and Msm are controlled independently based on the control signals CNT1, CNT2, CNT3, . . . , and CNTm that are supplied from the control-signal generating circuit 23. FIGS. 4A and 4B illustrate exemplary drive waveforms of control signals. The control signals illustrated in FIGS. 4A and 4B may be the control signals CNT1, CNT2, CNT3, . . . , and CNTm that are output from the control-signal generating circuit 23 illustrated in FIG. 3.

In the drive waveforms illustrated in FIG. 4A, one of the input-side transistors Mi1, Mi2, Mi3, . . . , and Mim is activated substantially at substantially the same time interval. The duty ratio of each of the control signals CNT1, CNT2, CNT3, . . . , and CNTm is set to 1/m, and one of the control signals CNT1, CNT2, CNT3, . . . , and CNTm may be exclusively asserted. For example, the control signals CNT1, CNT2, CNT3, . . . , and CNTm may be asserted for a time period of T (wherein the time period of T is a switching cycle) so that the time periods when the control signals are assorted do not overlap each other, and may be negated for a time period represented by an expression (m−1)×T. As illustrated in FIG. 4A, because the input-side transistors Mi to be activated is switched sequentially and one input-side transistor Mi is activated, for example, the current-source circuit illustrated in FIG. 3 corresponds to a current mirror circuit having a current mirror ratio of 1:n.

In the drive waveforms illustrated in FIG. 4B, the input-side transistor to be activated among the input-side transistors Mi1, Mi2, Mi3, . . . , and Mimis switched, and two of the input-side transistors Mi1, Mi2, Mi3, . . . , and Mim are activated. The duty ratio of each of the control signals CNT1, CNT2, CNT3, . . . , and CNTm is set to 2/m. Each of the control signals CNT1, CNT2, CNT3, . . . , and CNTm may be asserted for a time period of 2T (wherein the time period of T is a switching cycle), and may be negated for a time period represented by an expression (m−2)×T. As illustrated in FIG. 4B, the control signals CNT1, CNT2, CNT3, . . . , and CNTm are sequentially asserted for each time period of T, and the control signals that have been asserted for the time period of 2T are negated. As illustrated in FIG. 4B, because sequential switching among the input-side transistor Mi to be activated is switched sequentially and two input-side transistors Mi are activated, for example, the current-source circuit illustrated in FIG. 2 may correspond to a current mirror circuit having a current mirror ratio of 1:(n/2). As illustrated in FIG. 4B, even when a shift in timing when the control signals change occurs, at least one input-side transistor Mi is activated. A sharp change in the output current is reduced, so that the output current may be stabilized.

The control signals CNT1, CNT2, CNT3, . . . , and CNTm may activate three or more input-side transistors Mi1, Mi2, Mi3, . . . , and Mim contemporaneously. When one or two of the input-side transistors Mi1, Mi2, Mi3, . . . , and Mim are activated, a circuit area, e.g., the circuit area of the output-side transistors Mo, is reduced, and a large current mirror ratio may be obtained.

The current mirror circuit including the NMOS transistors may be a current-pulling-type (current-input-type) circuit. A current mirror circuit including P-channel MOS transistors (hereinafter, referred to as "PMOS transistors") may be a current-draining-type (current-output-type) circuit.

Figure 5:
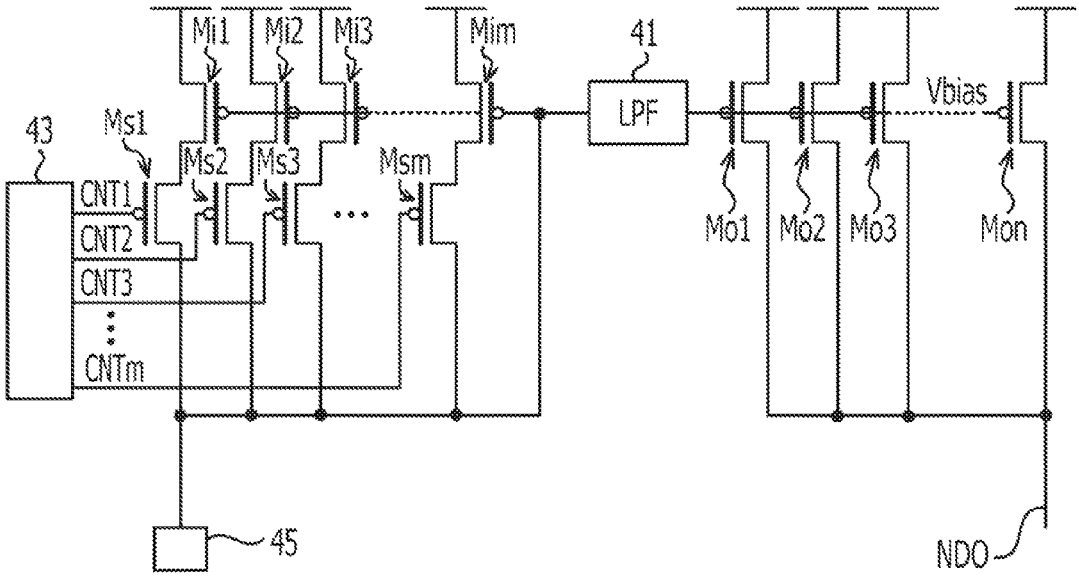
FIG. 5 illustrates an exemplary current-source circuit.

FIG. 5 illustrates an exemplary current-source circuit. The current-source circuit illustrated in FIG. 5 includes a current mirror circuit including PMOS transistors. Switches corresponding to the switches SW1, SW2, SW3, . . . , and SWm of the switching control circuit 13 illustrated in FIG. 2 may include PMOS transistors. Reference numerals Mi, Mo, and Ms denote PMOS transistors. Reference numeral 41 denotes a low-pass filter. Reference numeral 43 denotes a control-signal generating circuit. Reference numeral 45 denotes an input-current supply circuit.

The PMOS transistors Mi (Mi1, Mi2, Mi3, . . . , and Mim) may correspond to input-side transistors to which an input current is input. The PMOS transistors Mo (Mo1, Mo2, Mo3, . . . , and Mon) may correspond to output-side transistors that are current-mirror-coupled to the input-side transistors Mi so that an output current flows in accordance with the input current flowing into the input-side transistors Mi. The PMOS transistors Ms (Ms1, Ms2, Ms3, . . . , and Msm) may correspond to the switches SW included in the switching control circuit 13 illustrated in FIG. 2. The PMOS transistors Ms (Ms1, Ms2, Ms3, . . . , and Msm) are provided for the input-side transistors Mi1, Mi2, Mi3, . . . , and Mim, respectively, and switch and activate the corresponding input-side transistors Mi.

The drains of the input-side transistors Mi are coupled to the sources of the corresponding PMOS transistors Ms. The sources of the input-side transistors Mi are coupled to a power supply voltage (VDD). The gates of the input-side transistors Mi are coupled to the input-current supply circuit 45. The drains of the output-side transistors Mo are coupled to an output-current node NDO. The sources of the output-side transistors Mo are coupled to the power supply voltage (VDD). The gates of the output-side transistors Mo are coupled mutually to the gates of the input-side transistors Mi. The drains of the PMOS transistors Ms are coupled to the input-current supply circuit 45. Control signals CNT1, CNT2, CNT3, . . . , and CNTm that are supplied from the control-signal generating circuit 43 are supplied to the gates of the PMOS transistors Ms1, Ms2, Ms3, . . . , and Msm, respectively, and the PMOS transistors Ms1, Ms2, Ms3, . . . , and Msm are on/off controlled independently.

The control-signal generating circuit 43 generates the control signals CNT1, CNT2, CNT3, . . . , and CNTm. The input-current supply circuit 45 supplies the input current to the input-side transistors Mi. The operation of the current-source circuit illustrated in FIG. 5 may be substantially the same as or similar to one of the operations of the current-source circuits illustrated in the drawings.

The current-source circuit may include a current-pulling-type (current-input-type) current mirror circuit including NMOS transistors. Alternatively, the current-source circuit may include a current-draining-type (current-output-type) current mirror circuit including PMOS transistors.

Figure 6:
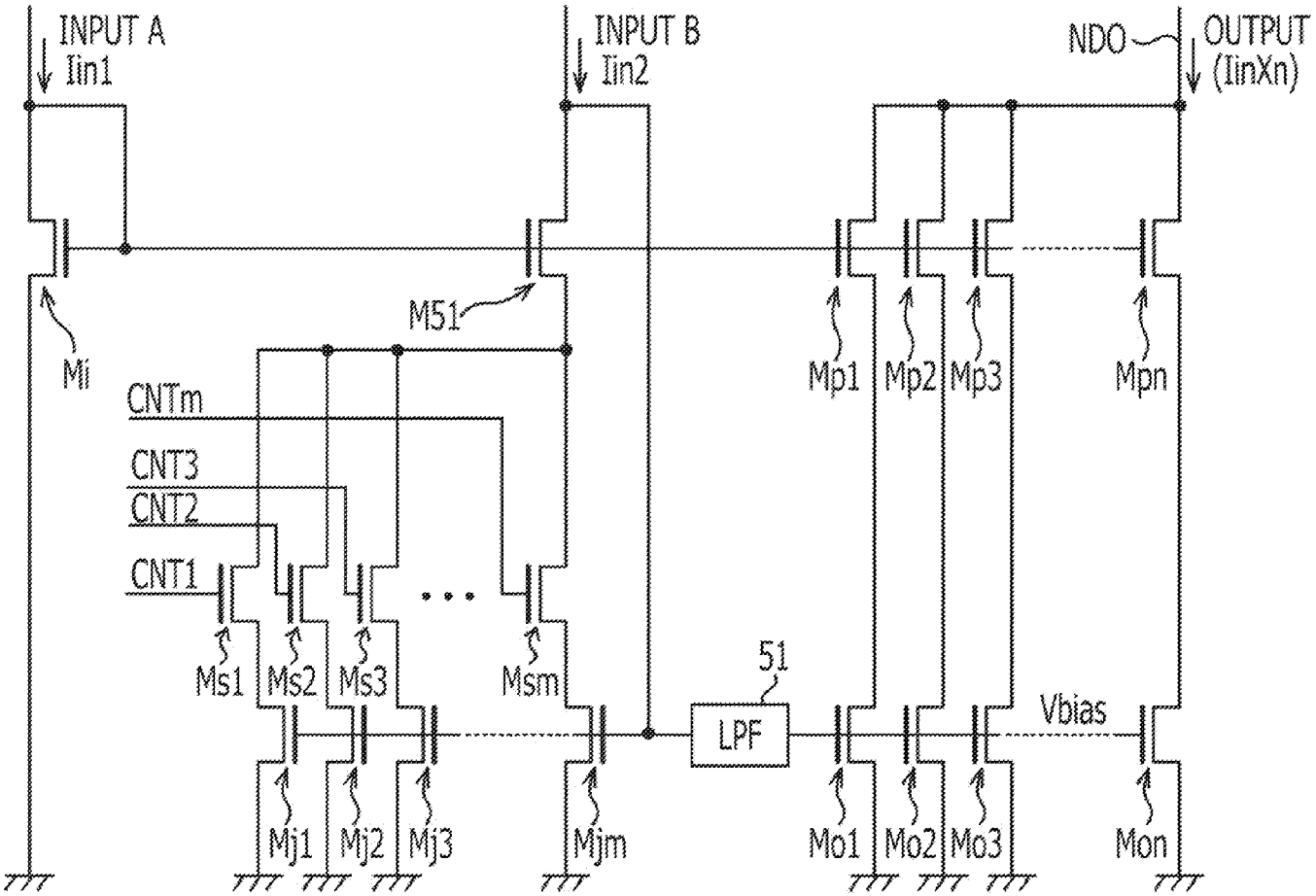
FIG. 6 illustrates an exemplary current-source circuit.

FIG. 6 illustrates an exemplary current-source circuit. The current-source circuit illustrated in FIG. 6 includes a cascode current mirror circuit. In FIG. 6, reference numerals Mi, Mj, Ms, M51, Mo, and Mp denote NMOS transistors. Reference numeral 51 denotes a low-pass filter. In FIG. 6, a control-signal generating circuit and an input-current supply circuit may not be illustrated.

The NMOS transistor Mi may correspond to an input-side transistor at an upper stage to which an input current Iin1 supplied from, for example, the input-current supply circuit that is not illustrated is input. The NMOS transistors M51 and Mp (Mp1, Mp2, Mp3, . . . , and Mpn) are current-mirror-coupled to the input-side transistor Mi at the upper stage so that an output current flows in accordance with the input current flowing into the input-side transistor Mi, which is provided at the upper stage. The NMOS transistors Mp (Mp1, Mp2, Mp3, . . . , and Mpn) are provided for the NMOS transistors Mo1, Mo2, Mo3, . . . , and Mon, respectively.

The NMOS transistors Mj (Mj1, Mj2, Mj3, . . . , and Mjm) may correspond to input-side transistors at a lower stage to which a current Iin2 flowing through the NMOS transistor M51 is input. The NMOS transistor M51 and the input-side transistor Mi at the upper stage are current-mirror-coupled to each other. Accordingly, the current Iin2 flowing into the NMOS transistor M51 may correspond to the input current Iin1 flowing into the input-side transistor Mi at the upper stage.

The NMOS transistors Mo (Mo1, Mo2, Mo3, . . . , and Mon) may correspond to output-side transistors that are current-mirror-coupled to the input-side transistors Mj at the lower stage so that an output current flows in accordance with a current flowing into the input-side transistors Mj at the lower stage. The NMOS transistors Ms (Ms1, Ms2, Ms3, . . . , and Msm) are provided for the input-side transistors Mj1, Mj2, Mj3, . . . , and Mjm at the lower stage, respectively, and may correspond to switches for switching the corresponding input-side transistors Mj at the lower stage.

The drain of the input-side transistor Mi at the upper stage is coupled to the input-current supply circuit. The source of the input-side transistor Mi is coupled to a reference potential VSS, e.g., the ground. The gate of the input-side transistor Mi is coupled to the drain of the input-side transistor Mi. The drain of the NMOS transistor M51 is coupled to a power supply. The gate of the NMOS transistor M51 is coupled to the gate of the input-side transistor Mi at the upper stage. The drains of the NMOS transistors Mp are coupled to an output-current node NDO. The gates of the NMOS transistors Mp are coupled mutually to the gate of the input-side transistor Mi at the upper stage.

The drains of the input-side transistors Mj at the lower stage are coupled to the sources of the corresponding NMOS transistors Ms. The sources of the input-side transistors Mj are coupled to the reference potential VSS, e.g., the ground. The gates of the input-side transistors Mj are coupled to the drain of the NMOS transistor M51. The drains of the NMOS transistors Ms are coupled to the source of the NMOS transistor M51. Control signals CNT (CNT1, CNT2, CNT3, . . . , and CNTm) are supplied to the gates of the NMOS transistors Ms. The NMOS transistors Ms1, Ms2, Ms3, . . . , and Msm are controlled independently based on the control signals CNT1, CNT2, CNT3, . . . , and CNTm, respectively, that are supplied from the control-signal generating circuit which is not illustrated.

The drains of the output-side transistors Mo are coupled to the sources of the corresponding NMOS transistors Mp. The sources of the output-side transistors Mo are coupled to the reference potential VSS, e.g., the ground. The gates of the output-side transistors Mo are coupled mutually to the gates of the input-side transistors Mj at the lower stage.

Because the cascode current mirror circuit illustrated in FIG. 6 is used, the stable currents are supplied from the current mirror circuits at the upper stage to the input-side transistors Mj at the lower stage and the output-side transistors Mo. The current accuracy of the current-source circuit may be increased.

Figure 7:
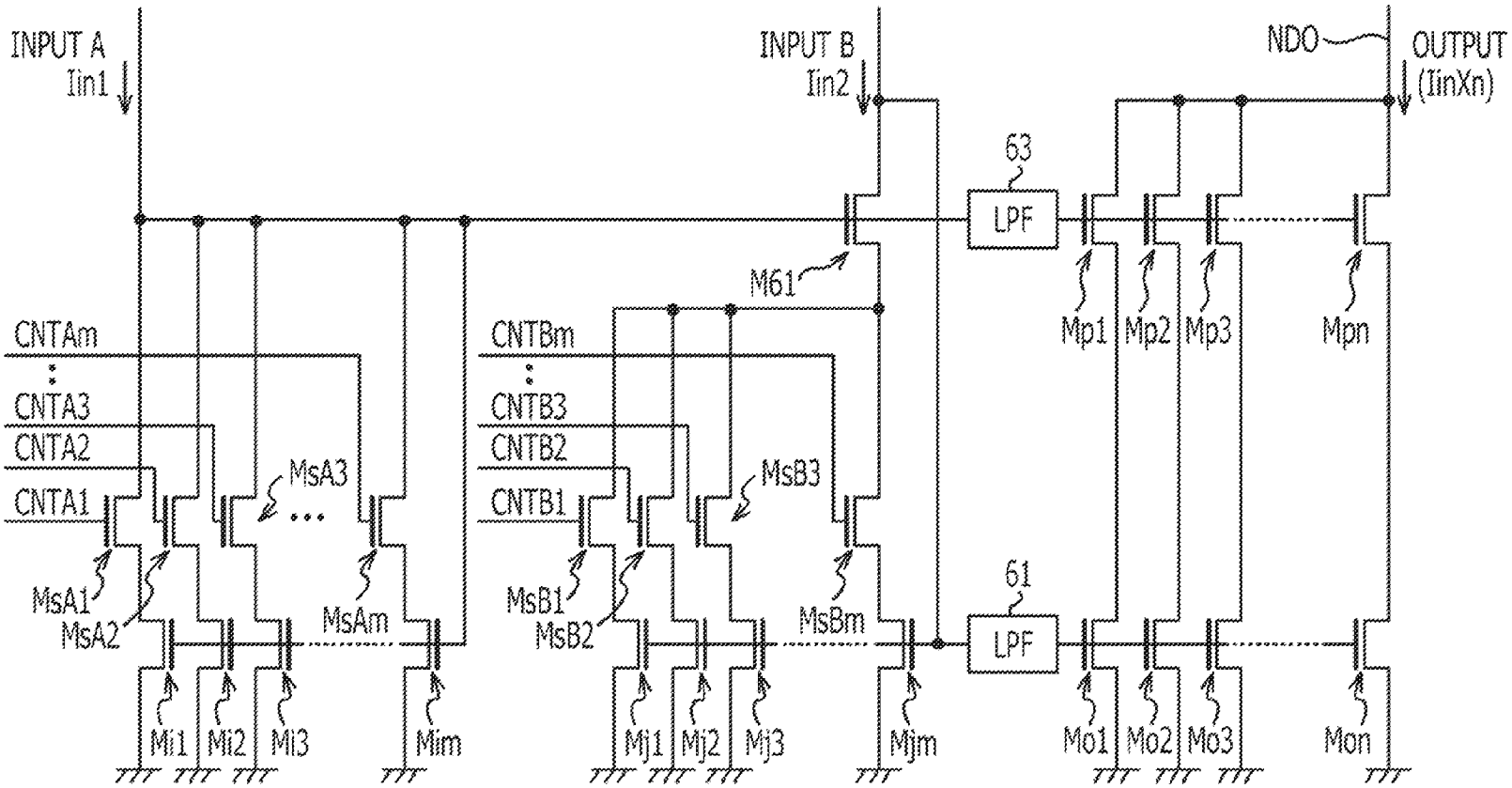
FIG. 7 illustrates an exemplary current-source circuit.

FIG. 7 illustrates an exemplary current-source circuit. A current mirror circuit at an upper stage included in the current-source circuit illustrated in FIG. 7 includes a plurality of input-side transistors Mi. Reference numerals Mi, Mj, MsA, MsB, M61, Mo, and Mp denote NMOS transistors. Reference numerals 61 and 63 denote low-pass filters. In FIG. 7, a control-signal generating circuit and an input-current supply circuit may not be illustrated. The NMOS transistors Mj, MsB, M61, Mo, and Mp may correspond to the NMOS transistors Mj, Ms, M51, Mo, and Mp, respectively, illustrated in FIG. 6. Control signals CNTB may correspond to the control signals CNT illustrated in FIG. 6.

The NMOS transistors Mi may correspond to input-side transistors at an upper stage to which an input current Iin1 supplied from the input-current supply circuit that is not illustrated is input. The NMOS transistors MsA (MsA1, MsA2, MsA3, . . . , and MsAm) are provided for the input-side transistors Mi1, Mi2, Mi3, . . . , and Mim. The NMOS transistors MsA activate the corresponding input-side transistors Mi at the upper stage.

The drains of the input-side transistors Mi at the upper stage are coupled to the sources of the corresponding NMOS transistors MsA. The sources of the input-side transistors Mi are coupled to a reference potential VSS, e.g., the ground. The gates of the input-side transistors Mi are coupled to the input-current supply circuit. The drains of the NMOS transistors MsA are coupled to the input-current supply circuit. Control signals CNTA are supplied to the gates of the NMOS transistors MsA. The NMOS transistors MsA1, MsA2, MsA3, . . . , and MsAm are controlled independently based on the control signals CNTA1, CNTA2, CNTA3, . . . , and CNTAm, respectively, that are supplied from the control-signal generating circuit which is not illustrated.

Because the current mirror circuit that is provided at the upper stage included in a cascode current mirror circuit includes the input-side transistors Mi and the input-side transistors are selectively activated, the current accuracy of the current-source circuit may be increased. In FIG. 7, the control signals CNTA and the control signals CNTB are independent of each other. However, the control signals CNTA and the control signals CNTB may be provided as shared control signals.

Figure 8:
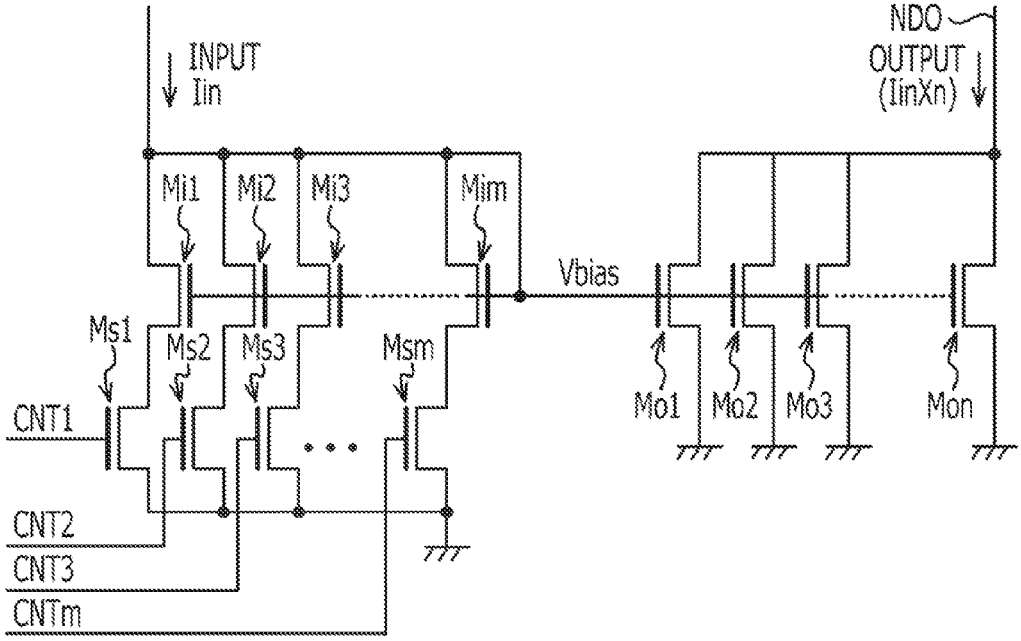
FIG. 8 illustrates an exemplary current-source circuit.

The transistors Ms having a switch function are provided on the drain side of the input-side transistors. FIG. 8 illustrates an exemplary current-source circuit. As illustrated in FIG. 8, transistors Ms having a switch function may be provided on the source side of the input-side transistors. In FIG. 8, the transistors Ms having a switch function are provided on the source side of the input-side transistors Mi of the current-source circuit illustrated in FIG. 3. Accordingly, an influence of the transistors Ms to a drain voltage of the input-side transistors is reduced, and coupling noise from switches, e.g., from the transistors Ms, to a node Vbias is reduced. When the transistors Ms having a switch function are provided on the drain side of the input-side transistors, a source voltage of the input-side transistors is stabilized, and the thresholds of the input-side transistors are stabilized.

The switches for selectively activating the input-side transistors may be transmission gates, each of which includes an NMOS transistor and a PMOS transistor. Because transmission gates are used as the switches for selectively activating the input-side transistors, the resistances of the switches are reduced, so that a process-dependent variation may be reduced.

Figure 9A:
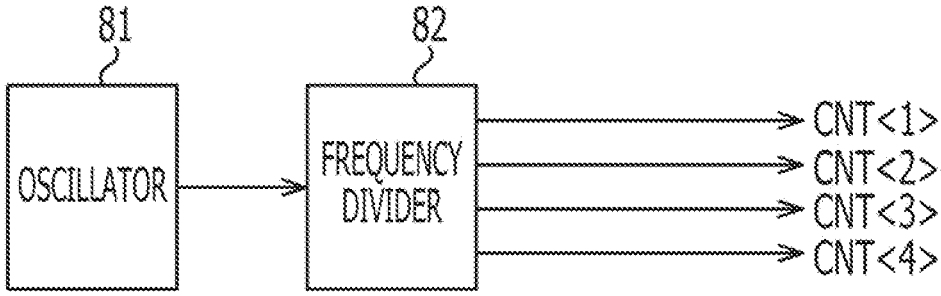
FIG. 9A illustrates an exemplary control-signal generating circuit.

FIG. 9A illustrates an exemplary control-signal generating circuit. The control-signal generating circuit illustrated in FIG. 9A may include a pulse generating circuit.

Figure 9B:
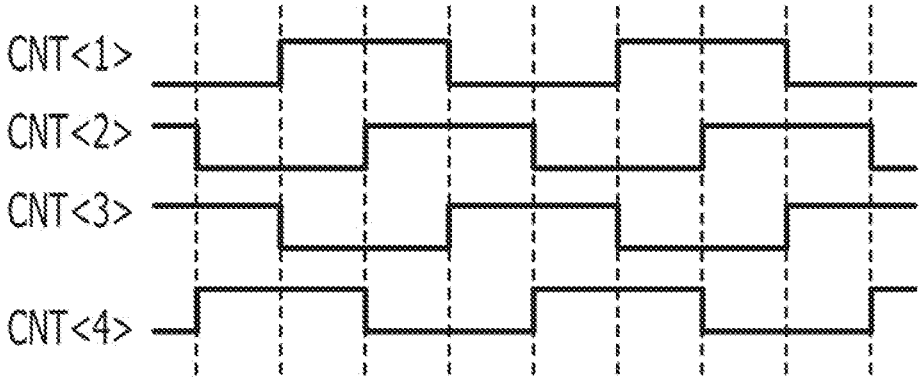
FIG. 9B illustrates exemplary control signals.

In FIG. 9A, reference numeral 81 denotes an oscillator. Reference numeral 82 denotes a frequency divider. The oscillator 81 oscillates a clock signal having a certain period. The frequency divider 82 generates, based on the clock signal that is output from the oscillator 81, frequency-division clock signals having phase differences of 0 degrees, 90 degrees, 180 degrees, and 270 degrees, respectively. FIG. 9B illustrates exemplary control signals. The control signals illustrated in FIG. 9B may be the frequency-division clock signals that are output from the frequency divider 82. The control signals may have a duty ratio illustrated in FIG. 9B.

Figure 10A:
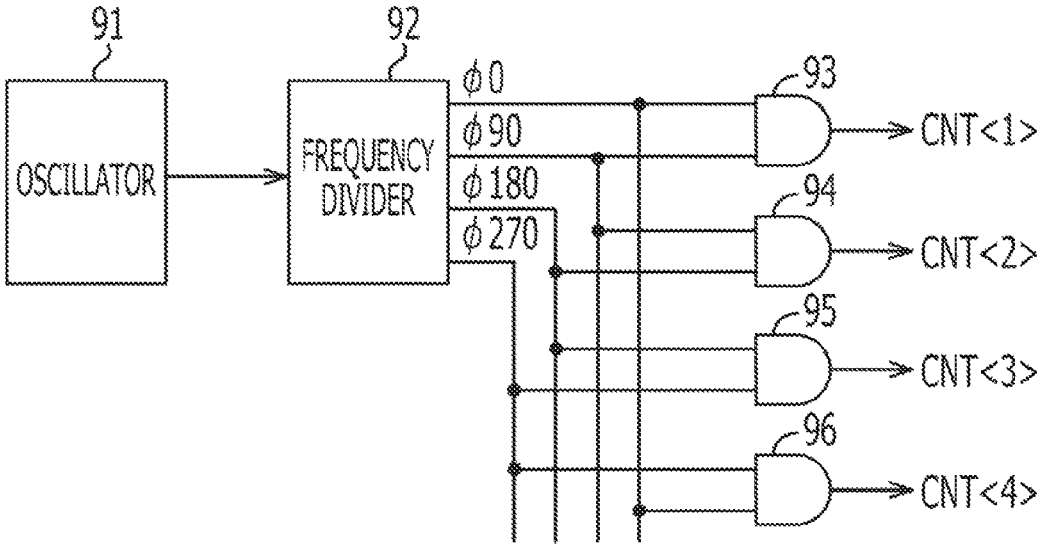
FIG. 10A illustrates an exemplary control-signal generating circuit.

FIG. 10A illustrates an exemplary control-signal generating circuit. In FIG. 10A, reference numeral 91 denotes an oscillator. Reference numeral 92 denotes a frequency divider. Reference numerals 93 to 96 denote AND operation circuits, e.g., AND circuits. The oscillator 91 oscillates a clock signal having a certain period. The frequency divider 92 generates, based on the clock signal that is output from the oscillator 91, frequency-division clock signals having phase differences of 0 degrees, 90 degrees, 180 degrees, and 270 degrees, respectively.

Figure 10B:
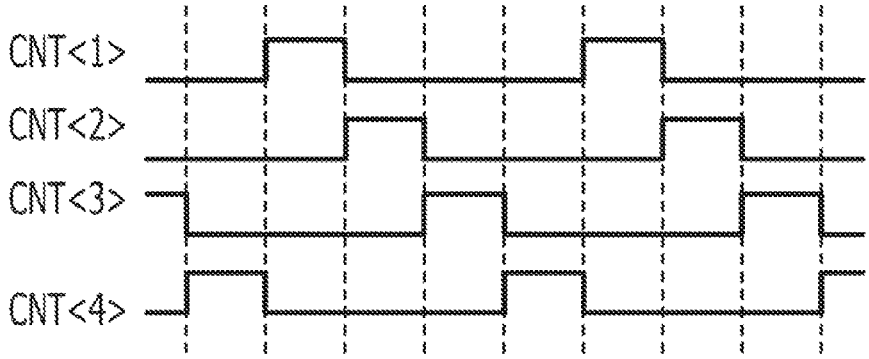
FIG. 10B illustrates exemplary control signals.

The AND circuit 93 outputs a result of an AND operation of the frequency-division clock signal having a phase difference of 0 degrees and the frequency-division clock signal having a phase difference of 90 degrees, which are output from the frequency divider 92. The AND circuit 94 outputs a result of an AND operation of the frequency-division clock signal having a phase difference of 90 degrees and the frequency-division clock signal having a phase difference of 180 degrees, which are output from the frequency divider 92. The AND circuit 95 outputs a result of an AND operation of the frequency-division clock signal having a phase difference of 180 degrees and the frequency-division clock signal having a phase difference of 270 degrees. The AND circuit 96 outputs a result of an AND operation of the frequency-division clock signal having a phase difference of 270 degrees and the frequency-division clock signal having a phase difference of 0 degrees. FIG. 10B illustrates exemplary control signals. The control signals illustrated in FIG. 10B may be output signals of the individual AND circuits 93 to 96. The control signals illustrated in FIG. 10B have a duty ratio illustrated in FIG. 10B.

In FIGS. 9A and 9B and FIGS. 10A and 10B, four control signals are generated based on the clock signals that are output from the oscillators 81 and 91. An arbitrary number of control signals may be generated. For example, AND operations of an arbitrary combination of frequency-division clocks having phase differences that differ from each other by (360/the number of control signals) degrees are performed, whereby control signals having an arbitrary duty ratio may be generated.

Figure 11:
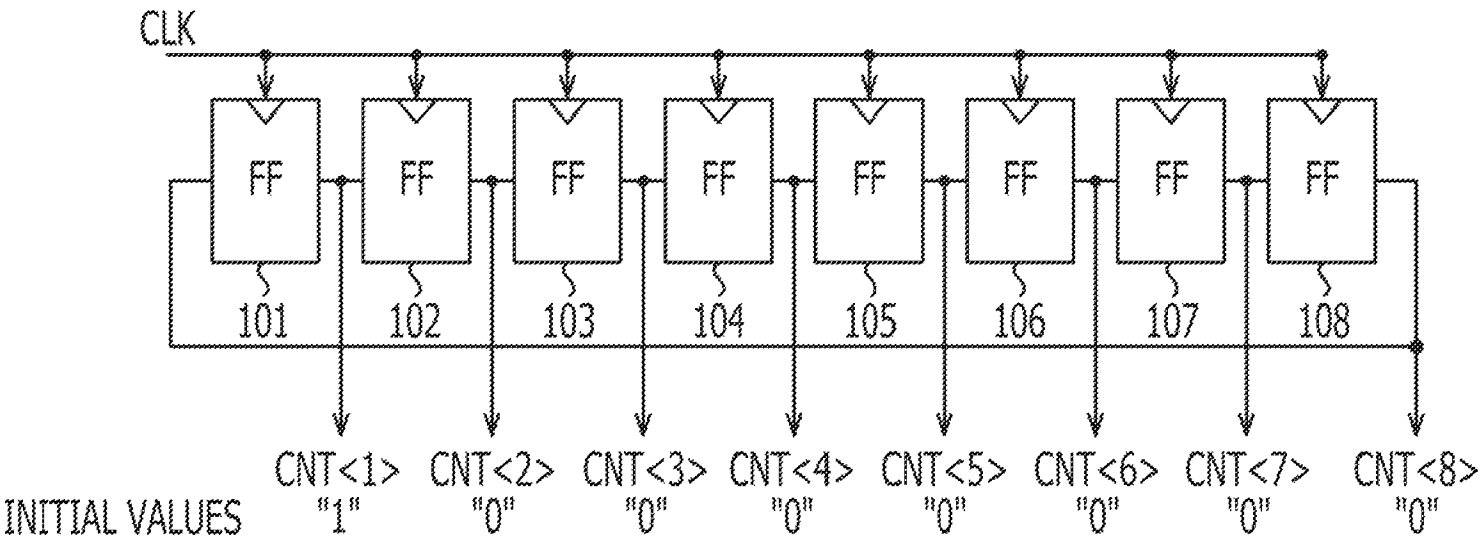
FIG. 11 illustrates an exemplary control-signal generating circuit.

FIG. 11 illustrates an exemplary control-signal generating circuit. The control-signal generating circuit illustrated in FIG. 11 may include a shift register. Reference numerals 101 to 108 in FIG. 11 denote flip-flops (FFs) included in the shift register. A clock signal CLK is supplied to the FFs 101 to 108. The FFs 101 to 108 output input signals in synchronization with the clock signal CLK. The FFs 101 to 108 are coupled in tandem (cascaded) so that the output of each of the FFs 101 to 108 is input to an FF at a subsequent stage. The output of the last FF, e.g., the FF 108, is input to the first FF, e.g., the FF 101. The shift register includes a loop in which the FFs 101 to 108 are coupled to each other. The outputs of the individual FFs 101 to 108 are output as control signals CNT. The duty ratio of the control signals CNT may be controlled based on initial values that are supplied to the FFs 101 to 108. In FIG. 11, eight control signals are generated. The FFs, the number of FFs corresponding to the number of control signals, are coupled in a loop, whereby an arbitrary number of control signals are generated.

Figure 12:
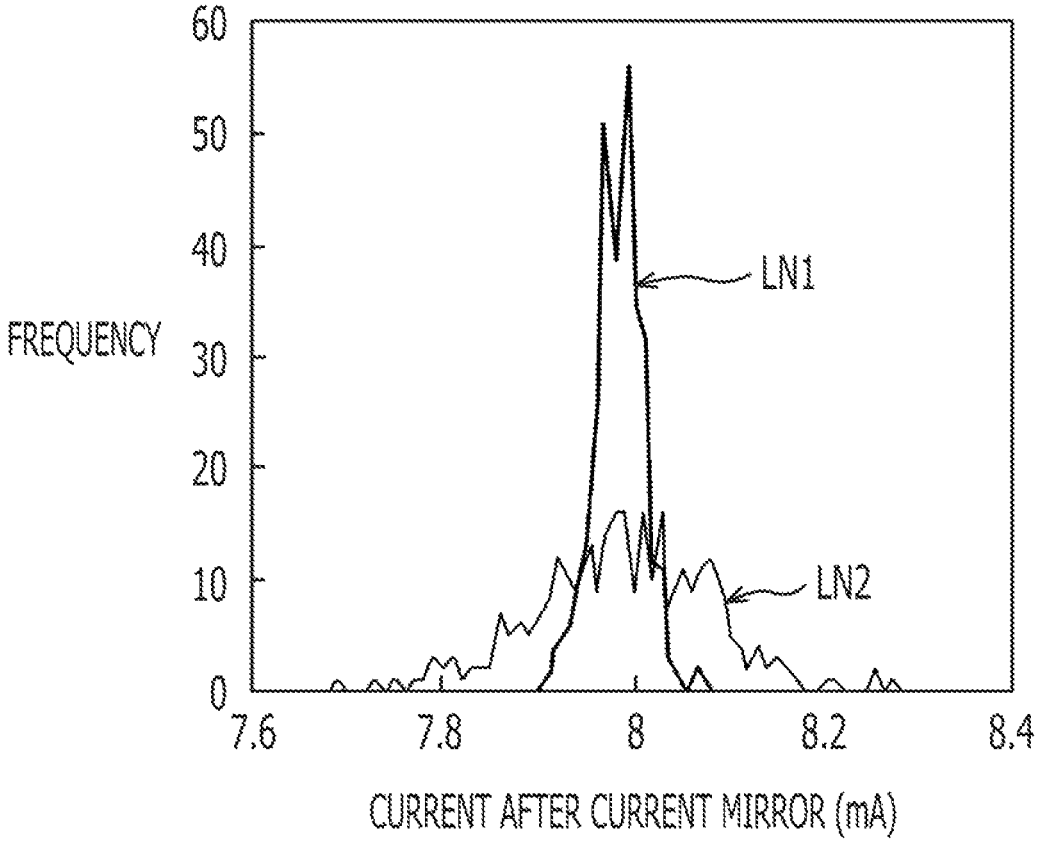
FIG. 12 illustrates exemplary output currents.

FIG. 12 illustrates exemplary output currents. FIG. 12 illustrates variations in output currents of current-source circuits. In FIG. 12, a result of simulation of output currents, using a Monte Carlo method, when eight input-side transistors are provided and the input-side transistors to be activated are switched is illustrated. In FIG. 12, reference numeral LN1 denotes a variation in an output current of a current-source circuit. Reference numeral LN2 denotes a variation in an output current of a current-source circuit when the size of the input-side transistors is eight times the original, for example, when an input current is supplied to eight input-side transistors. The variation LN1 in the output current of the current-source circuit is small, so that the stability of the output current may be increased.

All examples and conditional language recited herein are intended for pedagogical objects to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A current-source circuit comprising:

a plurality of input-side transistors;

a plurality of output-side transistors current-mirror-coupled to the plurality of input-side transistors;

an output terminal from which an output current is output; and a switching control circuit to switch the plurality of input-side transistors and activate at least one of the plurality of input-side transistors sequentially;

wherein time periods for which the plurality of input-side transistors are individually activated by the switching control circuit are substantially the same.

2. The current-source circuit according to claim 1, wherein the output current which is proportional to an input current flowing through the plurality of input-side transistors flows through the plurality of output-side transistors.

3. The current-source circuit according to claim 1, further comprising, a low-pass filter arranged between a gate of one input-side transistor among the plurality of input-side transistors and a gate of one output-side transistor among the plurality of output-side transistors.

4. The current-source circuit according to claim 1, wherein the switching control circuit includes a plurality of switches arranged, along current paths of the input current which flows through the plurality of input-side transistors, for each of the plurality of input-side transistors, the plurality of switches being controlled independently of one another.

5. The current-source circuit according to claim 4, further comprising, a control-signal generating circuit to generate control signals for control of the plurality of switches.

6. The current-source circuit according to claim 5, wherein the control-signal generating circuit includes a pulse generating circuit.

7. The current-source circuit according to claim 5, wherein the control-signal generating circuit includes a shift register circuit.

8. The current-source circuit according to claim 1, wherein the switching control circuit sequentially switches the plurality of input-side transistors and activates one of the plurality of input-side transistors.

9. The current-source circuit according to claim 1, wherein the switching control circuit sequentially switches the plurality of input-side transistors and activates two of the plurality of input-side transistors.

10. The current-source circuit according to claim 4, wherein the plurality of switches are arranged on a drain side of the plurality of input-side transistors.

11. The current-source circuit according to claim 4, wherein the plurality of switches are arranged on a source side of the plurality of input-side transistors.

12. The current-source circuit according to claim 4, wherein the plurality of switches include transmission gates.

13. A current-source circuit comprising:

a first current mirror circuit to receive an input current; and a second current mirror circuit, cascaded to the first current mirror circuit, to output an output current in accordance with the input current, wherein the second current mirror circuit includes:

a plurality of first input-side transistors through which the output current based on the input current supplied by the first current mirror circuit flows; and a first switching control circuit to sequentially switch the plurality of first input-side transistors and activate at least one of the plurality of first input-side transistors.

14. The current-source circuit according to claim 13, wherein the first current mirror circuit includes:

a plurality of second input-side transistors through which the input current flows; and a second switching control circuit to sequentially switch the plurality of second input-side transistors and activate at least one of the plurality of second input-side transistors.

* * * * *